US010682272B2

(12) United States Patent
Bellingroth

(10) Patent No.: US 10,682,272 B2
(45) Date of Patent: Jun. 16, 2020

(54) ADJUSTABLE SLATTED BED BASE

(71) Applicant: Sino Europe GmbH & Co. KG, Gummersbach (DE)

(72) Inventor: Klaus Bellingroth, Gummersbach (DE)

(73) Assignee: Sino Europe GmbH & Co. KG, Gummersbach (DE)

( * ) Notice: Subject to any disclaimer, the term of this patent is extended or adjusted under 35 U.S.C. 154(b) by 160 days.

(21) Appl. No.: 14/951,569

(22) Filed: Nov. 25, 2015

(65) Prior Publication Data

US 2016/0206488 A1 Jul. 21, 2016

(30) Foreign Application Priority Data

Jan. 19, 2015 (DE) ..... 10 2015 100 675

(51) Int. Cl.

| | |
|---|---|
| ***A61G 7/015*** | (2006.01) |
| ***A61G 7/018*** | (2006.01) |
| ***A61G 7/07*** | (2006.01) |
| ***A61G 7/075*** | (2006.01) |
| ***A47C 20/04*** | (2006.01) |

(52) U.S. Cl.

CPC ..... *A61G 7/015* (2013.01); *A47C 20/041* (2013.01); *A61G 7/018* (2013.01); *A61G 7/07* (2013.01); *A61G 7/072* (2013.01); *A61G 7/0755* (2013.01)

(58) Field of Classification Search

CPC ..... A47C 20/041; A61G 7/015; A61G 7/018; A61G 7/07; A61G 7/072; A61G 7/0755

See application file for complete search history.

(56) References Cited

U.S. PATENT DOCUMENTS 2,026,153 A 12/1935 Wright et al.
3,191,196 A * 6/1965 Holm ..... A61G 7/015 5/616

(Continued)

FOREIGN PATENT DOCUMENTS

DE 3347453 A1 8/1984
DE 29803619 U1 4/1998
WO WO-2007118667 A1 * 10/2007 ..... A47C 20/041

OTHER PUBLICATIONS

German Office Action dated Feb. 10, 2017, for German Priority Application No. 10 2015 100 675.8.

*Primary Examiner* — Nicholas F Polito

(74) *Attorney, Agent, or Firm* — Bachman and Lapointe PC; George Coury

(57) ABSTRACT

An adjustable slatted bed base with an outer frame and a lying surface with at least two sections, which is arranged on the outer frame, wherein at least one section is formed as a pivotable section which is pivotable relative to the outer frame, from a flat position into at least one angled position, by an adjusting unit, and the pivotable section has a support device for providing support relative to the outer frame. In order to provide an adjustable slatted bed base, which has a pivotable section which allows easy access to an area beneath the slatted bed base in any operating position, and can be returned to an operational condition quickly and easily, the support device is formed such that it can be disengaged from the outer frame in order to adjust the pivotable section from any set position into a folded-back position, and, when pivoting back into the set position, automatically engages with the outer frame in a supportive manner.

29 Claims, 5 Drawing Sheets

(56) References Cited

U.S. PATENT DOCUMENTS

| | | | | | |
|---|---|---|---|---|---|
| 3,267,493 | A * | 8/1966 | Pruim | A47C 20/041 | 5/611 |
| 3,278,952 | A * | 10/1966 | Holm | A47C 20/041 | 5/616 |
| 3,593,350 | A * | 7/1971 | Knight | A47C 20/041 | 5/616 |
| 4,110,856 | A * | 9/1978 | Benoit | A61G 7/00 | 5/618 |
| 4,573,226 | A | 3/1986 | Wittmann et al. | | |
| 5,205,004 | A * | 4/1993 | Hayes | A47C 20/041 | 5/611 |
| 2003/0052238 | A1* | 3/2003 | Schneider | A47C 20/041 | 248/157 |
| 2006/0130236 | A1* | 6/2006 | Dewert | A47C 1/0242 | 5/616 |
| 2006/0143827 | A1* | 7/2006 | Wilming | A47C 20/041 | 5/618 |
| 2015/0182398 | A1* | 7/2015 | Hollyoak | A61G 7/015 | 5/613 |

* cited by examiner

ADJUSTABLE SLATTED BED BASE

BACKGROUND OF THE INVENTION

The invention relates to an adjustable slatted bed base with an outer frame and a lying surface with at least two sections, arranged on the outer frame, wherein at least one section is formed as a pivotable section which is pivotable relative to the outer frame, from a flat position into at least one angled position, by means of an adjusting unit, and the pivotable section has a support device for providing support relative to the outer frame.

Various designs of adjustable slatted bed bases of the type mentioned in the beginning are known from the state of the art. Such bed bases are used, particularly with a bed frame and a mattress, in the private sector and also in the medical and care sectors, as beds for the sick, the elderly and those in need of care.

The pivotable arrangement of at least one section of the lying surface allows the form of the bed to be adapted to the needs of the user. This applies both to adapting the bed to a desired sleeping position and to changing from a sleeping position into a sitting position of the user for example. Here, a safe, stable support of the entire lying surface, including the pivotable sections thereof, is important.

Furthermore, since sections of an adjustable lying surface, particularly an adjustable leg section, are used by some users to facilitate getting up out of a bed, a particularly stable support of these sections of the lying surface relative to the outer frame is especially important, in order to prevent an unintended lowering and hence injury to the user.

However, the support devices known from the state of the art are disadvantageous in that, due to its connection to the outer frame by means of the support device, the pivotable section of the lying surface cannot be completely folded back easily, so as to enable access to the space beneath the slatted bed base, for example to clean or use it as storage space, or at least this requires a complicated unhooking of the support device to fold it back and hooking it up again to fold it up. In particular, the devices known from the state of the art make it difficult to change a pivotable section of the lying surface from a pivoted position into another position, in order to access the space beneath the slatted bed base and then to bring it back into an operational condition when folding it up.

Therefore, the object of the invention is to provide an adjustable slatted bed base, which has an adjustable section that enables easy access to an area beneath the slatted bed base in any desired operating position and can be returned to an operational condition quickly and easily.

SUMMARY OF THE INVENTION

According to the invention the object is achieved by means of a device as disclosed herein. Advantageous developments of the invention are also given as disclosed herein.

The adjustable slatted bed base according to the invention comprises an outer frame and a lying surface arranged on the outer frame, which has at least two sections. At least one of the sections of the lying surface is pivotable from a flat position into at least one angled position relative to the outer frame, by means of an adjusting unit, and, furthermore, this pivotable section has a support device to provide support relative to the outer frame. Characteristic of the slatted bed base according to the invention is the fact that the support device is formed such that said support device, for adjusting the pivotable section, can be brought from any set position into a folded-back position, with the outer frame disengaged, and reaches the set position automatically when pivoting back, with the outer frame engaged in support.

The design of the adjustable slatted bed base according to the invention has advantages over the slatted bed bases known from the state of the art in that, on the one hand, stable support of the pivotable section of the lying surface relative to the outer frame is achieved, and, on the other, the pivotable section can be brought from any position into a folded-back position easily, in order to gain access to the area beneath the slatted bed base. Then the pivotable section can be brought back into the position prior to the folding back, without the need for manual engagement of the support device. This allows both versatile use and easy cleaning of the space beneath the slatted bed base according to the invention.

A slatted bed base first means any device which is suitable as a base for at least one padded member, particularly a mattress, or another device of a bed for sleeping on, or another item of resting or sleeping furniture. In particular, a slatted bed base refers to a component or an assembly, which can be arranged on a bed frame, in order to receive such a padded member. Furthermore, the slatted bed base can have any additional functions.

The slatted bed base generally has an outer frame which can be designed as one piece or several pieces and made of any material. The outer frame is preferably made of metal, plastic, wood, a composite material, or of a combination of several of the aforementioned materials. The outer frame can be formed to border the slatted bed base on all four sides or merely consist of two components on the sides, connected to each other by means of connecting members. The outer frame generally refers to the component which gives the slatted bed base the necessary form stability.

The lying surface generally means the component or unit, which is on the side of the slatted bed base, on which the padded member should be arranged, or respectively which faces a user. The lying surface can consist of a large number of different components, these preferably being made of elastic members made of wood, plastic or metal. In particular, the lying surface can have a plurality of slats made of wood or plastic arranged parallel to each other, or respectively of metal or wire members arranged in parallel or in the form of a grid. These elastic members can be connected directly to the outer frame or be a part of an assembly arranged on the outer frame.

The slatted bed base according to the invention comprises a lying surface which has at least two sections, these sections referring to portions of the lying surface, which are structurally separate from each other and which are adjustable relative to each other, preferably by being pivoted or tilted.

An adjusting unit generally means a structural member or a structural assembly, which is suitable for adjusting the at least one pivotable section of the lying surface relative to the outer frame, or respectively relative to the other section of the lying surface, particularly to vary the angle between two sections of the lying surface. This can refer to both a purely mechanical device and an electrically adjustable device.

A flat position of the pivotable section of the lying surface means the position in which this section of the lying surface is arranged parallel to the outer frame and/or in a plane with the remaining section of the lying surface. Here, this flat position is the position in which the pivotable section of the lying surface has the smallest possible adjusting angle, usually of about 0°, relative to the outer frame, or respectively to the remaining lying surface.

On the other hand, the angled position first of all generally refers to a position of the pivotable section of the lying surface, which is characterised by an angle deviating from the adjusting angle of the flat position, the angled position meaning particularly the position of the maximum possible adjustment of the pivotable section of the lying surface relative to the outer frame, by means of the adjusting unit. Here, angles of up to 90° between the adjustable section of the lying surface and the outer frame are possible in principle, and in cases of some special applications even beyond that.

Consequently, whatever the set position, this refers to a position of the pivotable section of the lying surface relative to the outer frame, or respectively relative to the remaining lying surface, which lies between the flat position and the maximum possible angled position. Here, adjustment into the set position is generally carried out by means of the adjusting unit. Depending on the type of adjusting unit, each of the possible positions between the flat position and the angled position can be adopted in a stepless manner, or only one, predetermined, discrete number of options for set positions is given.

The folded-back position means a position of the pivotable section of the lying surface, in which the pivotable section is pivoted by a user, with no influence from the adjusting unit, so as to enable access to the space beneath the slatted bed base. Here, with the slatted base according to the invention, it is generally possible to bring the pivotable section of the lying surface from any set position into a folded-back position. Moreover, the pivotable section of the lying surface can be designed such that it can be moved further than the maximum possible angled position, when being pivoted into the folded-back position.

Pivoting back means the process in which a user moves the pivotable section of the lying surface from the folded-back position into the set position in which the pivotable section of the lying surface lay prior to the adjustment into the folded-back position by the user, without using the adjusting unit.

The support device may generally be any assembly of one or several pieces, which is formed to support the pivotable section of the lying surface relative to the outer frame, the support device providing support independently of an adjustment of the pivotable section by means of the adjusting unit. In particular, in every possible set position of the pivotable section, the support device and the outer frame are in operative connection, i.e. the support device and the outer frame are always engaged in a supportive manner.

On the other hand, when a user adjusts the pivotable section of the lying surface into the folded-back position, the operative connection between the support device and the outer frame is cancelled, that is, the support device is disengaged from the outer frame.

When pivoting back, the support device re-establishes operative connection with the outer frame automatically, automatically meaning that, in this context, the user does not have to manipulate the support device at all when it pivots back, in order to re-establish the operative connection. That is, the support device re-engages in a supportive manner, without the user touching or having any effect thereon.

According to an advantageous embodiment of the invention, the lying surface, particularly the pivotable section of the lying surface, comprises an inner frame arranged on the outer frame. Basically, the inner frame can be formed of one or several pieces and made of any material. The inner frame is preferably made of metal, plastic, wood, a composite material or of a combination of several of the aforementioned materials and most preferably of the same material as the outer frame. The inner frame can surround the lying surface, or respectively the pivotable section of the lying surface, on all four sides or consist of merely two components on the sides, which are connected to each other by means of connecting members. According to a particularly advantageous embodiment of the invention, the inner frame is pivotably arranged directly on the outer frame, whereby the pivotability of a section of the lying surface can be realised particularly easily.

According to an advantageous further embodiment of the invention, the support device is connected articulately to the pivotable section of the lying surface, preferably to the inner frame, and has a stop member for restricting the pivotability of the support device relative to the pivotable section of the lying surface, whereby it can be particularly easy to ensure that, when pivoting back, the support device re-engages with the outer frame automatically.

According to an equally preferred embodiment of the invention, the support device comprises a lever which is fixed to the pivotable section of the lying surface, preferably to the inner frame, by means of a fitting that has the stop member.

In an advantageous embodiment of the invention, one support device is arranged on each of two opposite sides of the pivotable section of the lying surface, whereby a particularly stable support is provided easily. Here, each of the two support devices is arranged on the side of the inner frame which is fixed pivotably relative to the outer frame.

According to a preferred embodiment of the invention, the support device comprises a receiving member arranged on the outer frame, which cooperates with the lever in every position between the flat position and the angled position, the receiving member preferably being arranged on a side of the outer frame, which faces the pivotable section of the lying surface, whereby it can be particularly easy to provide support for the lever on the outer frame, produce the outer frame in an especially cost-effective manner and give the support device an especially diverse adaptability to the respective requirements.

According to an advantageous further embodiment of the invention, the receiving member has a sliding surface and a stop surface for the lever, the lever lying against the stop surface in every position between the flat position and the angled position. Here, it is most preferable for the sliding surface to be arranged parallel to the outer frame and/or the lying surface. Similarly, the stop surface is preferably designed as perpendicular to the outer frame and/or the lying surface.

According to another advantageous further embodiment of the invention, the sliding surface is formed such that, when pivoting from the folded-back position into any angled position or into the flat position, the lever engages with said sliding surface and is guided in a sliding manner thereon up to the stop surface, whereby it is easy to ensure that the lever re-engages automatically when the pivotable section of the lying surface pivots back independently of the set position.

According to a preferred embodiment of the invention, the lever is arranged such that, when pivoting from the folded-back position into any angled position or into the flat position, the angle towards the stop surface, which is between the sliding surface of the receiving member and the lever, is greater than 90°, to ensure that the lever always slides along the sliding surface, towards the stop surface.

A preferred embodiment of the invention comprises an electric motor and most preferably a spindle drive as part of the adjusting unit, by means of which the pivotable section of the lying surface is most preferably pivotable in a stepless manner from the flat position up to a maximum possible adjusted position, whereby a user can adjust the slatted bed base particularly easily.

According to a preferred embodiment of the invention, the lying surface has a pivotable leg section and/or upper body section as a pivotable section relative to the outer frame. Similarly, the pivotable leg section is preferably formed of a thigh section and a lower leg section, which are articulately connected to each other. Moreover, the pivotable upper body section is preferably formed of a back section and a head section, which are articulately fixed to each other. Such embodiments make it possible in an especially easy manner to provide the adjustable slatted bed base with a diverse capacity to be adjusted and customised.

According to a similarly preferred embodiment of the invention, the clearance between the outer frame and at least one section of the lying surface, preferably at least one pivotable section of the lying surface and most preferably all the pivotable sections of the lying surface and entirely most preferably the inner frame, is at least 25 mm, preferably at least 28 mm, whereby the user, especially the fingers, are prevented from becoming jammed particularly easily, when the slatted bed base is being adjusted between sections of the lying surface, in particular the inner frame and the outer frame.

BRIEF DESCRIPTION OF THE DRAWINGS

In the following an embodiment of the adjustable slatted bed base according to the invention is described in more detail with reference to the drawings. In the figures.

DETAILED DESCRIPTION

Figure 1:
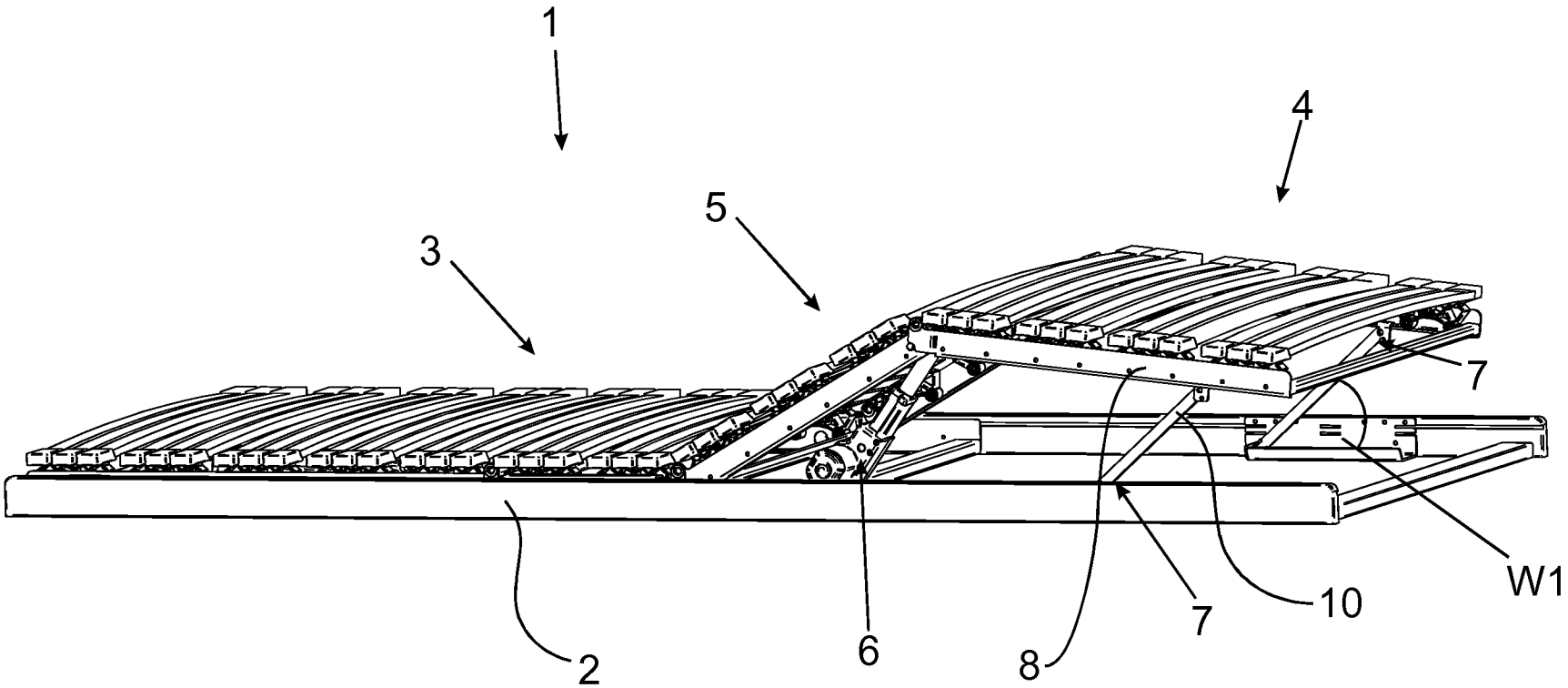
FIG. 1 shows a perspective view of an adjustable slatted bed base with a leg section in an angled position.

An adjustable slatted bed base 1 shown in FIG. 1 has an outer frame 2 surrounding the slatted bed base 1. A lying surface 3 is arranged on the outer frame 2, which is formed of several sections 4, 5 which are pivotable in relation to each other. Each of the sections 4, 5 of the lying surface 3 is formed of an inner frame 8 surrounding the section 4, 5, on which are arranged elastic wooden slats 23. Each of the inner frames 8 is arranged within the outer frame 2.

To enable the movable sections 4, 5 of the lying surface 3 to be pivoted relative to the remaining lying surface 3, or respectively relative to the outer frame 2, the inner frame 8 is articulately connected to the outer frame 2 and an adjusting unit 6 is arranged between the outer frame 2 and at least one of the movable sections 4, 5 of the lying surface 3.

Figure 2:
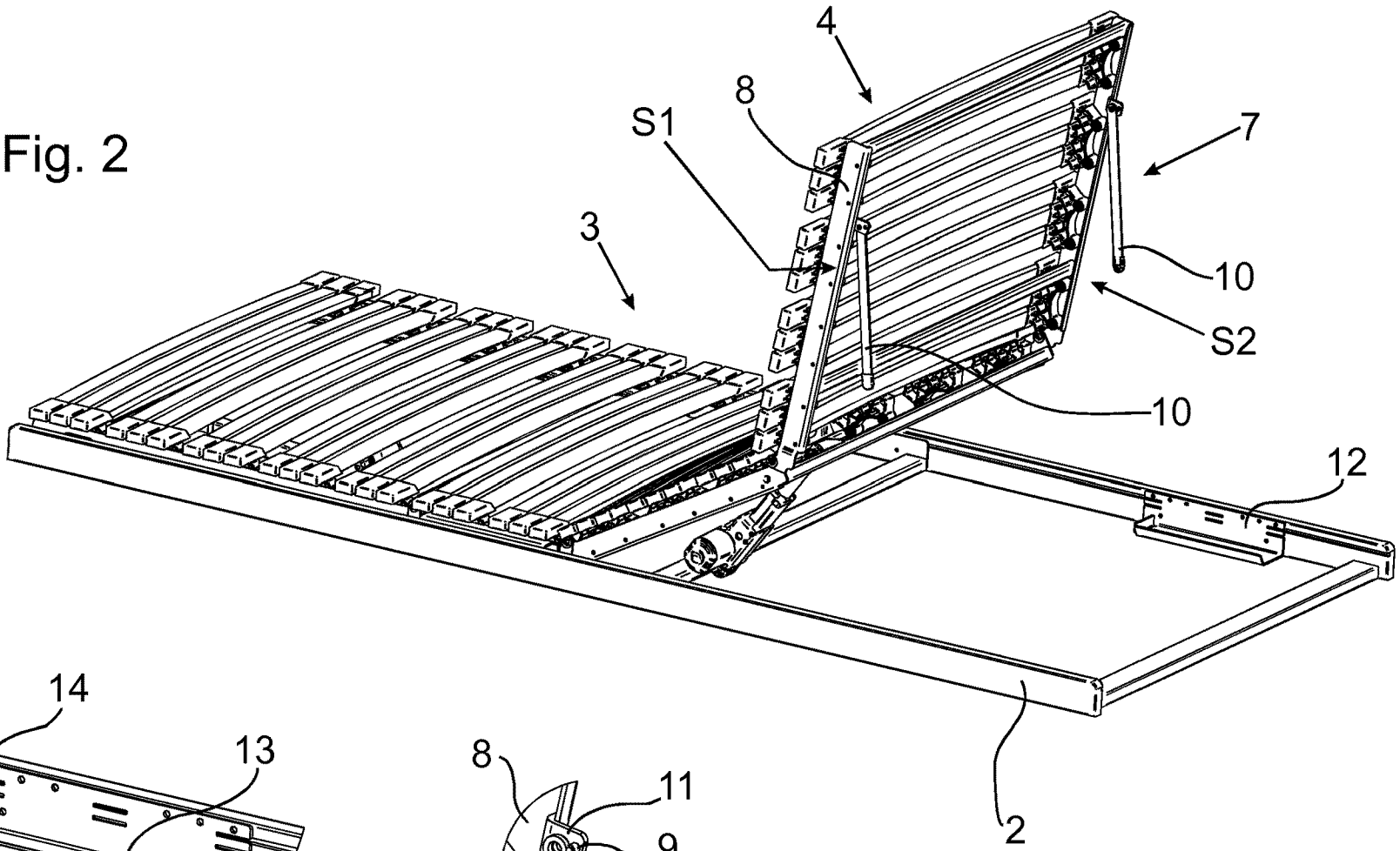
FIG. 2 shows a perspective view of the slatted bed base shown in FIG. 1, with a thigh section of the leg section in an angled position and a lower leg section of the leg section in a folded-back position.

To support the pivotable section 4 of the lying surface 3, a support device 7 is arranged on both sides, S1 and S2, of the inner frame 8 of the pivotable section 4 (see FIG. 2), which supports the pivotable section 4 of the lying surface 3 relative to the outer frame 2, the support device 7 being in operative connection with the outer frame 2 by means of a lever 10, in each operational position of the pivotable section 4, which is set by means of the adjusting unit 6. Here, the angle $W_1$ between the lever 10 and the outer frame 2, or respectively the sliding surface 13 of a receiving member 12 arranged on the outer frame 2, is always smaller than 90° (see FIG. 3*b*).

Figure 5:
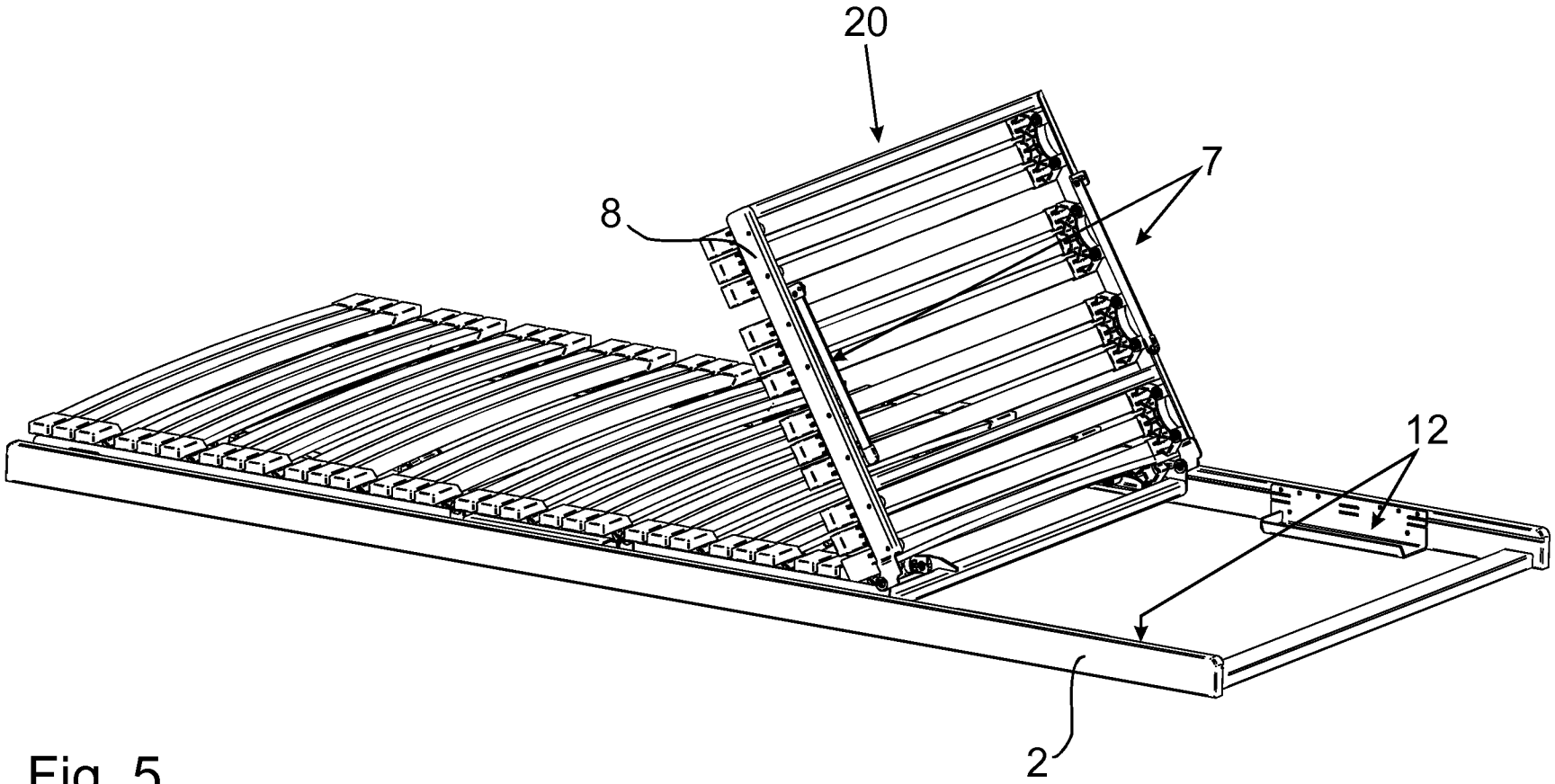
FIG. 5 shows a perspective view of the slatted bed base with a thigh section of the leg section in a flat position and the lower leg section of the leg section in a folded-back position.

Moreover, the pivotable section 4 and the support device 7 are designed such that, in any position of the pivotable section 4, which is set by means of the adjusting unit 6, the pivotable section 4 can be further folded back manually by a user (see FIGS. 2 and 5), in order to gain access to the space beneath the slatted bed base 1, the lever 10 of the support device 7 becoming disengaged from the outer frame 2, or respectively from the receiving member 12 arranged thereon, when the pivotable section 4 is manually folded back.

Furthermore, the support device 7 is designed such that, when the pivotable section 4 is manually folded from a folded-back position back into the position previously set by means of the adjusting unit 6, the lever 10 always re-engages with the outer frame 2, or respectively the receiving member 12, automatically, without the user having to guide or engage this, for example.

Figure 3B:
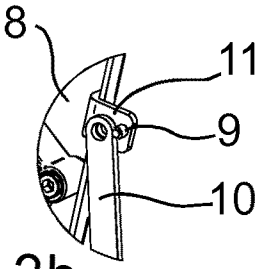
FIG. 3*b* shows a perspective detail of the receiving member of the support device which is arranged on an outer frame of the slatted bed base shown in FIG. 2.
Figure 3A:
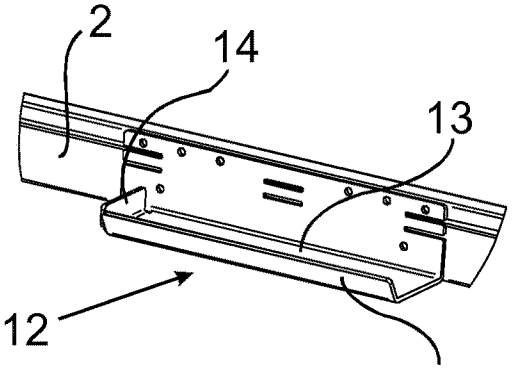
FIG. 3*a* shows a perspective detail of the section of a support device, which is arranged on an inner frame of the slatted bed base shown in FIG. 2.

The section of the support device 7, which is arranged on the inner side of the inner frame 8, which faces away from the outer frame 2, is shown in detail in FIG. 3*a*. A fitting 11, on which the lever 10 is articulately arranged, is fixed to the inner frame 8. Furthermore, the fitting 11 has a stop member 9 in the form of a bolt which is arranged on the stop member 11, such that the maximum pivotability of the lever 10 relative to the fitting 11, or respectively relative to the inner frame 8 of the pivotable section 4, is restricted. In particular, the stop member 9 is arranged such that, when a user folds down from a folded-back position, the lever 10 does not hang down entirely perpendicularly, or respectively along the plumb line, but such that the lever 10 comes into contact with the stop member 9 at least shortly before reaching the position of the pivotable section 4, which is set by means of the adjusting unit 6, and is thereby forced out of the position, which is perpendicular, or respectively follows the plumb line.

Moreover, according to the detailed illustration in FIG. 3*b*, next to the sliding surface 13 that runs parallel to the outer frame 2, the receiving member 12, which is arranged on the outer frame 2, has a stop surface 14 which is arranged substantially perpendicular to the sliding surface 13. Furthermore, the receiving member 12 comprises a restricting raised section 24, which runs along the sliding surface 13 and substantially perpendicular thereto, in order to guide the lever 10 sideways, or respectively to prevent the lever 10 springing down from the receiving member 12.

Figure 4:
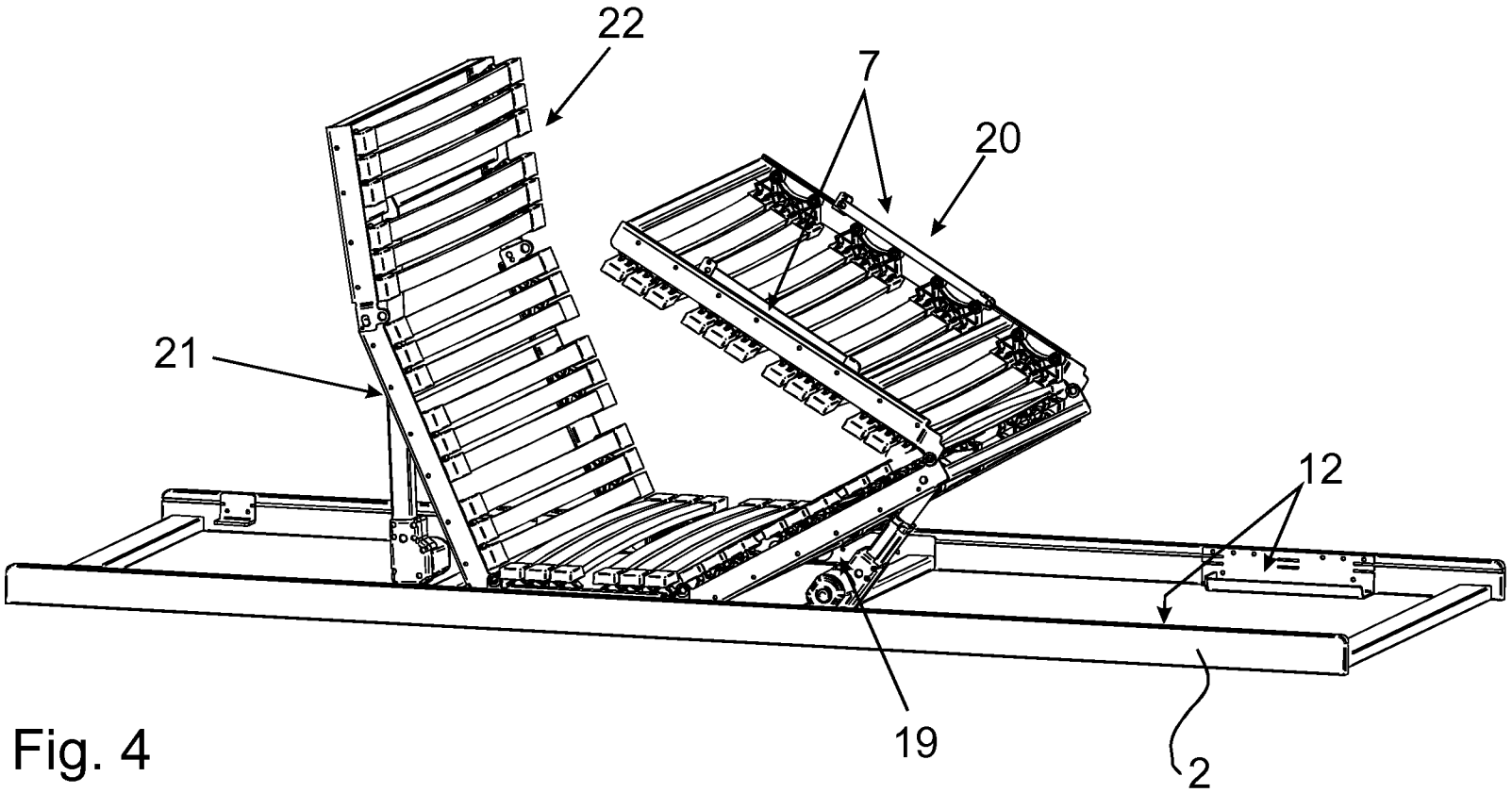
FIG. 4 shows a perspective view of the slatted bed base shown in FIG. 1, with a lower leg section of the leg section in a folded-back position and an upper body section in an angled position.
Figure 6:
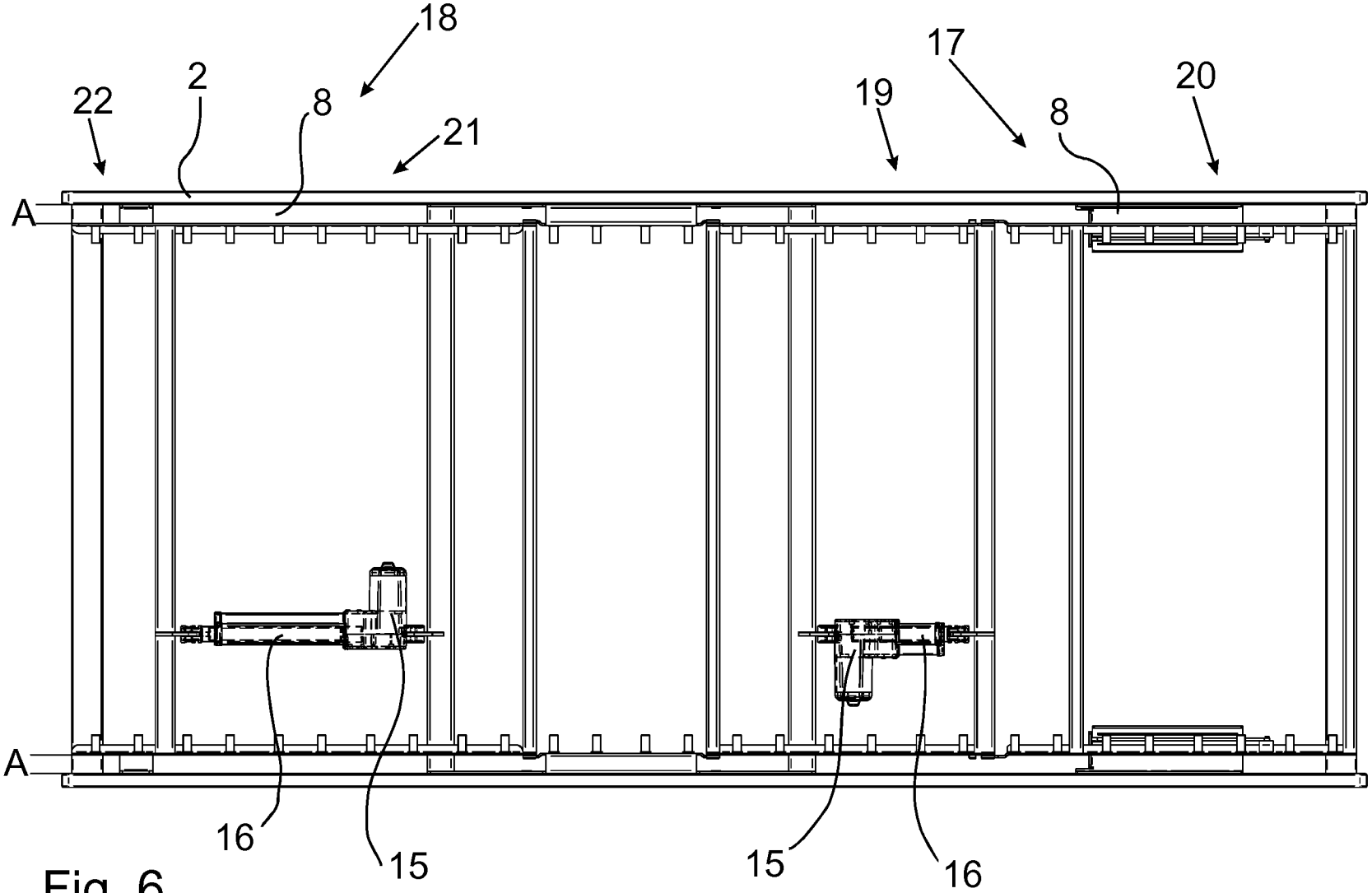
FIG. 6 shows a schematic view of the slatted bed base.

As shown in FIGS. 4 and 6, the adjustable slatted bed base 1 comprises a leg section 17, which is movable relative to the outer frame 2, said leg section being formed of a thigh section 19 arranged on the outer frame 2 and a lower leg section 20 articulately arranged on the thigh section 19. Here the thigh section 19 can be adjusted relative to the outer frame 2 in a stepless manner, by means of an adjusting unit 6, which is formed of an electric motor 15 and a spindle drive 16 cooperating therewith, while the lower leg section 20 has a support device 7 on both sides, to provide support relative to the outer frame 2. Moreover, the slatted bed base 1 comprises an upper body section 18, which is formed out of a back section 21, which is pivotably arranged on the outer frame 2 and can be adjusted by means of an adjusting unit 6, and a head section 22 which is articulately arranged on the back section 21.

The clearance A between an inner side of the outer frame 2, which faces the inner frame 8, and the inner frame 8 of all the movable sections 4, 5 and 17-22 of the lying surface 3, is at least 28 mm, in order to prevent the user becoming jammed while the adjustable slatted bed base 1 is in operation.

The invention claimed is:

1. Adjustable slatted bed base (1) with an outer frame (2) and a lying surface (3) with at least two sections (4,5), arranged on the outer frame (2), wherein at least one section is formed as a pivotable section (4) which is pivotable into at least one angled position relative to the outer frame (2) between a flat position and a maximum adjusted position, by means of an adjusting unit (6), and the pivotable section (4) has a support device (7) for providing support relative to the outer frame (2) in the at least one angled position, wherein the support device (7) is articulately connected to the pivotable section (4) of the lying surface (3), wherein the pivotable section (4) is further pivotable away from the outer frame (2) beyond the maximum adjusted position to a folded back position to allow access to an area beneath the pivotable section (4), the support device (7) rests against the outer frame (2) in the at least one angled position, wherein movement of the pivotable section (4) to the folded back position moves the support device (7) away from the outer frame (2), and wherein movement of the pivotable section (4) from the folded back position to the at least one angled position re-engages the support device (7) with the outer frame (2) and automatically reaches the at least one angled position in which the pivotable section (4) was set prior to movement into the folded back position.

2. Adjustable slatted bed base according to claim 1, wherein the lying surface (3) comprises an inner frame (8) arranged on the outer frame (2).

3. Adjustable slatted bed base according to claim 2, wherein the support device (7) has a stop member (9) for restricting the pivotability of the support device (7) relative to the pivotable section (4) of the lying surface (3) such that, during movement from the folded back position to the at least one angled position, the stop member prevents the support device from hanging down perpendicularly.

4. Adjustable slatted bed base according to claim 3, wherein the support device (7) has a lever (10), which is fixed on the pivotable section (4) of the lying surface (3) by means of a fitting (11) with the stop member (9).

5. Adjustable slatted bed base according to claim 3, wherein the lever (10), is fixed on the inner frame (8) by means of the fitting (11) with the stop member (9).

6. Adjustable slatted bed base according to claim 1, wherein the pivotable section (4) of the lying surface (3), comprises an inner frame (8) arranged on the outer frame (2).

7. Adjustable slatted bed base according to claim 1, wherein the support device (7) has a stop member (9) for restricting the pivotability of the support device (7) relative to the pivotable section (4) of the lying surface (3) such that, during movement from the folded back position to the at least one angled position, the stop member prevents the support device from hanging down perpendicularly.

8. Adjustable slatted bed base according to claim 7, wherein the support device (7) has a lever (10), which is fixed on the pivotable section (4) of the lying surface (3) by means of a fitting (11) with the stop member (9).

9. Adjustable slatted bed base according to claim 8, wherein the lever (10), is fixed on the inner frame (8) by means of the fitting (11) with the stop member (9).

10. Adjustable slatted bed base according to claim 8, wherein the support device (7) comprises a receiving member (12) arranged on the outer frame (2), which cooperates with the lever (10) in any position at all between the flat position and the angled position, wherein the receiving member (12) is arranged on a side of the outer frame (2), facing the pivotable section (4) of the lying surface (3).

11. Adjustable slatted bed base according to claim 10, wherein the receiving member (12) has a sliding surface (13) and a stop surface (14) for the lever (10), wherein the lever (10) lies against the stop surface (14) in every position between the flat position and the angled position.

12. Adjustable slatted bed base according to claim 11, wherein the sliding surface (13) is formed such that, when pivoting from the folded-back position into any angled position or into the flat position, the lever (10) engages therewith and is guided in a sliding manner thereon, as far as the stop surface (14).

13. Adjustable slatted bed base according to claim 11, wherein the lever (10) is arranged such that, when it pivots from the folded-back position into any angled position or the flat position, the angle (W1) between the sliding surface (13) of the receiving member (12) and the lever (10), towards the stop surface (14), is greater than 90°.

14. Adjustable slatted bed base according to claim 1, wherein a support device (7) is arranged on each of two opposite sides (S1, S2) of the pivotable section (4) of the lying surface (3).

15. Adjustable slatted bed base according to claim 1, wherein the adjusting unit (6) comprises an electric motor (15) and a spindle drive (16), by means of which the pivotable section (4) of the lying surface (3) is pivotable from the flat position as far as a maximum angled position in a stepless manner.

16. Adjustable slatted bed base according to claim 1, wherein the pivotable section (4) of the lying surface (3) is a leg section (17) and/or upper body section (18), which is pivotable relative to the outer frame (2).

17. Adjustable slatted bed base according to claim 16, wherein the pivotable leg section (17) is formed of a thigh section (19) and a lower leg section (20), which are articulately fixed to each other.

18. Adjustable slatted bed base according to claim 16, wherein the pivotable upper body section (18) is formed of a back section (21) and a head section (22), which are articulately fixed to each other.

19. Adjustable slatted bed base according to claim 1, wherein the clearance (A) between the outer frame (2) and at least one section (4, 5) of the lying surface (3), is at least 25 mm.

20. Adjustable slatted bed base according to claim 1, wherein the clearance (A) between the outer frame (2) and at least the pivotable section (4) of the lying surface (3) is at least 25 mm.

21. Adjustable slatted bed base according to claim 1, wherein the clearance (A) between the outer frame (2) and all pivotable sections of the lying surface (3), is at least 25 mm.

22. Adjustable slatted bed base according to claim 1, wherein the clearance (A) between the outer frame (2) and at least one section (4, 5) of the lying surface (3) is at least 28 mm.

23. Adjustable slatted bed base according to claim 1, wherein the clearance (A) between the outer frame (2) and at least the pivotable section (4) of the lying surface (3) is at least 28 mm.

24. Adjustable slatted bed base according to claim 1, wherein the clearance (A) between the outer frame (2) and all pivotable sections of the lying surface (3), is at least 28 mm.

25. Adjustable slatted bed base (1) with an outer frame (2) and a lying surface (3) with at least two sections (4,5), arranged on the outer frame (2), wherein at least one section is formed as a pivotable section (4) which is pivotable from a flat position into at least one angled position relative to the outerframe (2), by means of an adjusting unit (6), and the pivotable section (4) has a support device (7) for providing support relative to the outer frame (2), wherein the support device (7) is articulately connected to the pivotable section (4) of the lying surface (3), wherein the support device (7) is formed such that based solely on manually folding back the pivotable section (4), the support device (7) becomes disengaged from the outer frame (2), thereby cancelling an operative connection between the support device (7) and the outer frame (2), to adjust the pivotable section (4) from any set position into a folded-back position, wherein the lying surface is moved further than a maximum possible angled position adjustable by means of the adjusting unit (6), and when pivoting back into the set position, it re-engages with the outer frame (2) in a supportive manner automatically and automatically reaches the at least one angled position in which the pivotable section (4) was set prior to movement into the folded back position.

26. Adjustable slatted bed base (1) with an outer frame (2) and a lying surface (3) with at least two sections (4,5), arranged on the outer frame (2), wherein at least one section is formed as a pivotable section (4) which is pivotable from a flat position into at least one angled position relative to the outerframe (2), by means of an adjusting unit (6), and the pivotable section (4) has a support device (7) for providing support relative to the outer frame (2), wherein the support device (7) is articulately connected to the pivotable section (4) of the lying surface (3), wherein the support device (7) is formed such that it is in an operative connection with the outer frame (2) by means of a lever (10) in each operational position of the pivotable section (4) which is set by means of the adjusting unit (6), based solely on manually folding back the pivotable section (4) further than a maximum possible angled position adjustable by means of the adjusting unit (6), the lever (10) of the support device (7) becomes disengaged from the outer frame (2), thereby cancelling an operative connection between the lever (10) and the outer frame (2), and when pivoting back the pivotable section (4) into the set position, the lever (10) re-engages with the outerframe (2) automatically and automatically reaches the at least one angled position in which the pivotable section (4) was set prior to movement into the folded back position.

27. Adjustable slatted bed base (1) with an outer frame (2) and a lying surface (3) with at least two sections (4,5), arranged on the outer frame (2), wherein at least one section is formed as a pivotable section (4) which is pivotable into at least one angled position relative to the outer frame (2) between a flat position and a maximum adjusted position, by means of an adjusting unit (6), and the pivotable section (4) has a support device (7) for providing support relative to the outer frame (2) in the at least one angled position, wherein the pivotable section (4) is further pivotable away from the outer frame (2) beyond the maximum adjusted position to a folded back position to allow access to an area beneath the pivotable section (4), the support device (7) rests against the outer frame (2) in the at least one angled position, wherein movement of the pivotable section (4) to the folded back position moves the support device (7) away from the outer frame (2), and wherein movement of the pivotable section (4) from the folded back position to the at least one angled position re-engages the support device (7) with the outer frame (2), and the support device (7) is articulately connected to the pivotable section (4) of the lying surface (3), and has a stop member (9) for restricting the pivotability of the support device (7) relative to the pivotable section (4) of the lying surface (3) such that, during movement from the folded back position to the at least one angled position, the stop member prevents the support device from hanging down perpendicularly.

28. Adjustable slatted bed base (1) with an outer frame (2) and a lying surface (3) with at least two sections (4,5), arranged on the outer frame (2), wherein at least one section is formed as a pivotable section (4) which is pivotable from a flat position into at least one angled position relative to the outer frame (2), by means of an adjusting unit (6), and the pivotable section (4) has a support device (7) for providing support relative to the outer frame (2), wherein the support device (7) is formed such that based solely on manually folding back the pivotable section (4), the support device (7) becomes disengaged from the outer frame (2), thereby cancelling an operative connection between the support device (7) and the outer frame (2), to adjust the pivotable section (4) from any set position into a folded-back position, wherein the lying surface is moved further than a maximum possible angled position adjustable by means of the adjusting unit (6), and when pivoting back into the set position, it re-engages with the outer frame (2) in a supportive manner automatically and the support device (7) is articulately connected to the pivotable section (4) of the lying surface (3), and has a stop member (9) for restricting the pivotability of the support device (7) relative to the pivotable section (4) of the lying surface (3) such that, during movement from the folded back position to the at least one angled position, the stop member prevents the support device from hanging down perpendicularly.

29. Adjustable slatted bed base (1) with an outer frame (2) and a lying surface (3) with at least two sections (4,5), arranged on the outer frame (2), wherein at least one section is formed as a pivotable section (4) which is pivotable from a flat position into at least one angled position relative to the outer frame (2), by means of an adjusting unit (6), and the pivotable section (4) has a support device (7) for providing support relative to the outer frame (2), wherein the support device (7) is formed such that it is in an operative connection with the outer frame (2) by means of a lever (10) in each operational position of the pivotable section (4) which is set by means of the adjusting unit (6), based solely on manually folding back the pivotable section (4) further than a maximum possible angled position adjustable by means of the adjusting unit (6), the lever (10) of the support device (7) becomes disengaged from the outer frame (2), thereby cancelling an operative connection between the lever (10) and the outer frame (2), and when pivoting back the pivotable section (4) into the set position, the lever (10) re-engages with the outer frame (2) automatically and the support device (7) is articulately connected to the pivotable section (4) of the lying surface (3), and has a stop member (9) for restricting the pivotability of the support device (7) relative to the pivotable section (4) of the lying surface (3) such that, during movement from the folded back position to the at least one angled position, the stop member prevents the support device from hanging down perpendicularly.

* * * * *